US005181603A

United States Patent [19]

Mori et al.

[11] Patent Number: 5,181,603

[45] Date of Patent: Jan. 26, 1993

[54] SEALED ELECTRIC SWITCH

[75] Inventors: Hidetaka Mori; Yasunari Takedomi, both of Tsu; Takao Morimoto, Hisai, all of Japan

[73] Assignee: Matsushita Electric Works, Ltd., Osaka, Japan

[21] Appl. No.: 629,654

[22] Filed: Dec. 10, 1990

[30] Foreign Application Priority Data

Dec. 25, 1989 [JP] Japan ..... 1-148930
Dec. 25, 1989 [JP] Japan ..... 1-148931

[51] Int. Cl.[5] ..... H01H 13/06; H01H 9/04
[52] U.S. Cl. ..... 200/302.1; 200/302.2
[58] Field of Search ..... 200/302.1, 302.2, 302.3, 200/303; 425/542; 264/273, 274

[56] References Cited

U.S. PATENT DOCUMENTS 2,566,636 9/1951 Renholts ..... 425/542 X
3,898,310 8/1975 Schiemann ..... 264/273
3,983,205 9/1976 Barrett ..... 264/273
4,535,827 8/1985 Seaford ..... 264/273
4,654,493 3/1987 Drager et al. ..... 200/302.1

FOREIGN PATENT DOCUMENTS 1160058 12/1963 Fed. Rep. of Germany .
1197956 8/1965 Fed. Rep. of Germany .
2018763 11/1971 Fed. Rep. of Germany .
3731016 3/1989 Fed. Rep. of Germany .

*Primary Examiner*—Henry J. Recla
*Assistant Examiner*—David J. Walczak
*Attorney, Agent, or Firm*—Stevens, Davis, Miller & Mosher

[57] ABSTRACT

A sealed electric switch comprises a molded switch housing and a separately formed cover which fits on the switch housing wiht an annular seal member interposed between mating peripheral surfaces of the switch housing and the cover. An annular seal member is injection-molded from an elastic material on the mating peripheral surface of the switch housing between separable molding dies with the switch housing held therebetween. The annular seal member is integrally formed with an additional segment which extends in a separating direction of the molding dies and joins at its end to the annular seal member so as to reinforce it against a separation force applied thereto at the time of separating the molding dies.

5 Claims, 5 Drawing Sheets

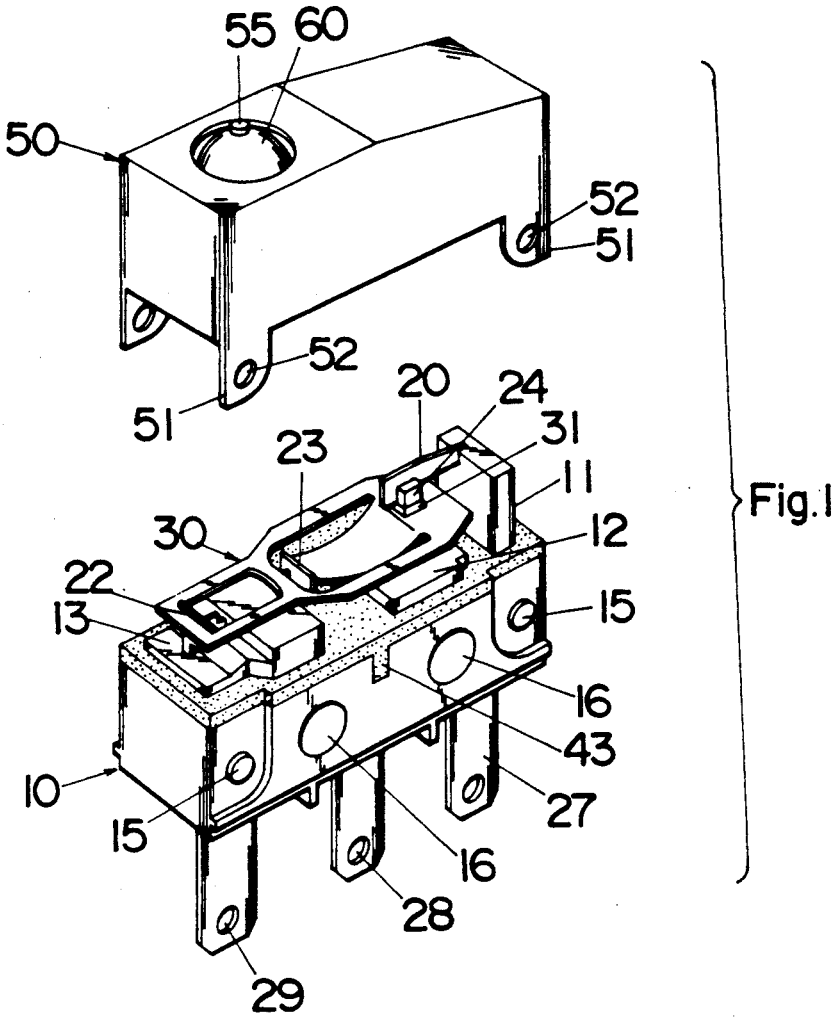
Fig.1
Fig.2
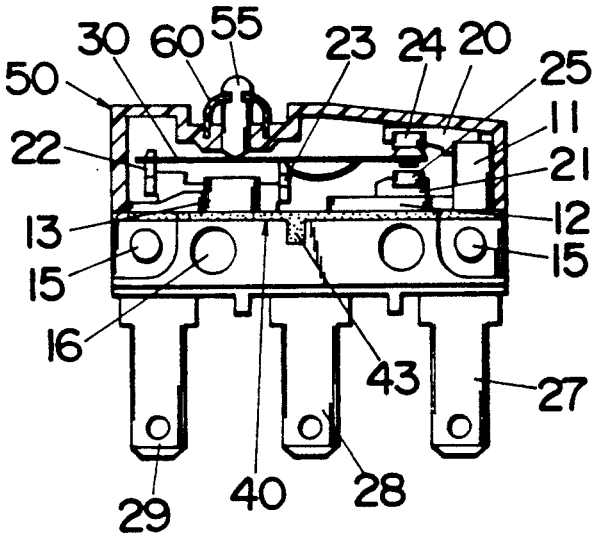

SEALED ELECTRIC SWITCH

BACKGROUND OF THE INVENTION

1. Field of the Invention

The present invention is directed to a sealed electric switch, and more particularly to a sealing structure between a molded switch housing and a separately formed cover by means of a seal member which is additionally molded on the switch housing.

2. Description of the Prior Art

For sealing of electric switches composed of a switch housing and a cover, it has been a general practice to interpose an annular seal member between peripheral mating surfaces of the housing and the cover. The prior art suggests that it is effective, particularly for miniature electric switches, to form the seal member as being additionally molded on the peripheral mating surface of the switch housing for secure and precise positioning thereof. Such additional molding can be effected by an injection molding which, as typically shown in FIG. 13, utilizes separable molding dies 1 and 2 to hold the switch housing 10 therebetween and injects an elastic material to form the annular seal member 40 around the top periphery of the switch housing 10. In the figure, the switch housing 10 is shown with its top contact mounting surface lying in the plane of the paper. In this structure, however, there remains a problem that, as shown in FIG. 13, when separating the molding dies 1 and 2 after injection-molding of the seal member 40, the seal member 40 is likely to be pulled in the separating directions of the dies 1 and 2 to thereby leave partial separations from the switch housing 10, which eventually lowers and even nullify the sealing between the switch housing and the cover.

SUMMARY OF THE INVENTION

The above problem has been eliminated in the present invention which provides an improved sealing structure for electric switches. The sealed electric switch in accordance with the present invention comprises a molded switch housing mounting contacts and terminals, and a separately formed cover which is fitted on the molded switch housing in mating contact between peripheries of the switch housing and the cover. Disposed between the peripheral mating surfaces of the switch housing and the cover is an annular seal member for effecting a sealing therebetween. The annular seal member is injection-molded from an elastic material, such as polyester elastomer, on the peripheral mating surface of the molded switch housing between separable molding dies with the switch housing held therebetween. The annular seal member is integrally formed with an additional segment which extends in a separating direction of the molding dies and joins at its end to the annular seal member so as to reinforce it against a separation force applied thereto at the time of separating the molding dies. With this reinforcement, the annular seal member can be firmly secured to the periphery of the switch housing to thereby assure a highly effective seal between the switch housing and the cover over an extended time of use.

Accordingly, it is a primary object of the present invention to provide a sealed electrical switch in which an annular seal member can be injection-molded on the periphery of a switch housing to be inseparably secured thereto for enhanced sealing between the switch housing and the cover.

In a preferred embodiment of the present invention, the annular seal member includes as the additional segment an integral bridge segment or segments which bridge across the opposed ends of the annular seal member within the same plane and in the separating direction as that of the dies. The thus formed bridge segment or segments serve also to increase the dimension stability of the seal member to be therefore effective for the intended sealing.

The switch housing may be provided with a bore extending therethrough in the separating direction of the molding dies. The bore is filled with the elastic material during the injection-molding to form therein an embedded anchor segment as the additional segment which extends in the separating direction and is integrally joined at its one end to the annular seal member. This is particularly advantageous for a situation where no space is available on the surface of the switch housing for bridging the opposed ends of the annular seal member due to, for example, close mounting of the contacts on that surface, which is therefore another object of the present invention.

Further, the bore may be formed to have a bend intermediate its ends to form a corresponding shouldered bend within the length of the resulting anchor segment of the elastic material formed in the bore. These bent portions are therefore in locking engagement with each other to thereby firmly hold the anchor segment in position, which gives a strong resistance to a force acting in the separating direction of the molding dies to thereby firmly retain the annular seal member in position on the periphery of the switch housing.

It is therefore a further object of the present invention to provide a sealed electric switch in which the injection-molded annular seal member can be firmly secured in position on the periphery of the switch housing by means of an additional anchor segment with a bent portion firmly engaged in switching housing.

The present invention further discloses an advantageous feature of avoiding scratching of the molded switch housing by the molding dies at the time of the injection-molding, as well as avoiding leaving a burr around the injection-molded annular seal member by providing suitable drafts on the contacting surfaces of the switch housing with the corresponding surfaces of the molding dies. With the provision of the drafts, the molding dies can be prevented from scratching the contacting surfaces of the switch housing to thereby avoid otherwise causing scratched particles which would stick to the periphery of the switch housing reducing the sealing effect, to causing a burr on the seal member, and marring the finish of the product.

It is therefore a still further object of the present invention to provide a sealed electric switch with a housing which is free from being scratched at the time of forming the annular seal member by injection-molding between the molding dies to thereby assure reliable sealing and avoiding a bur on the finished annular seal member.

These and still other objects and advantageous features of the present invention will become more apparent from the following description of the preferred embodiment when taken in conjunction with the attached drawings.

BRIEF DESCRIPTION OF THE DRAWINGS

FIG. 1 is an exploded perspective view of a sealed electric switch in accordance with a first embodiment of the present invention;

FIG. 2 is an elevation of the switch with its cover shown in section;

DETAILED DESCRIPTION OF THE PREFERRED EMBODIMENTS

Figure 3:
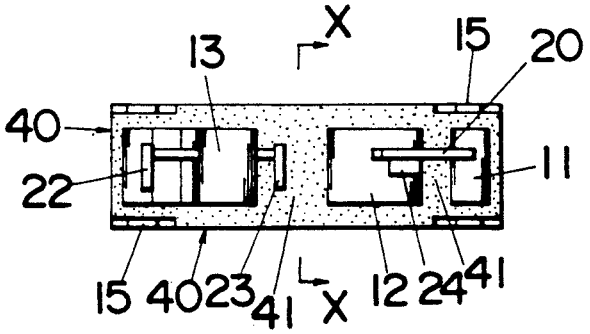
FIG. 3 is a top view of a housing of the switch with a contact spring removed therefrom.

Referring now to FIGS. 1 to 4, a sealed electric switch in accordance with a first embodiment of the present invention is shown by way of example as a miniature snap action switch. The switch comprises a housing 10 having a generally rectangular top mounting surface on which raised blocks 11, 12, and 13 project while leaving a continuous band extending around the entire periphery of the top surface. A detachable cover 50 is fitted on the switch housing 10 to have its lower edge in mating engagement with the entire top periphery of the switch housing 10. Depending from the corners of the cover 50 are resilient flaps 51 with catch holes 52 into which corresponding pegs 15 on side corners of the housing 10 engage for exact positioning of the cover 50 on the housing 10. The housing 10 is molded from a thermoplastic resin, for example, PBT (poly-butylene-telephtalate) to have integrally molded-in carriers 20 to 23 and terminals 27 to 29. The cover 50 is molded also from a like resin. The carriers 20 and 21 project on the block 11 and 12 to have respective contacts 24 and 25 welded thereto. The other carriers 22 and 23 project on the block 13 to support thereon a self-biased snap action spring 30 which carries a movable contact 31 at its one end and is stable at a position of engaging the contact 31 with the upper contact 24. An actuator 55 extends through the upper wall of the cover 50 to have its lower end in abutting engagement with the spring 30 so as to move the spring into a position of engaging the contacts 31 to the lower contact 25 upon depression of the actuator 55. The actuator 55 is surrounded by a boot seal 60 which mounts the actuator 55 in a sealed fashion to the cover 50. The terminals 27 to 29 have their upper portions integrally embedded in the housing 10 and connected respectively through carriers 20, 21, and 23 with the contacts 24, 25, and 31.

Figure 11:
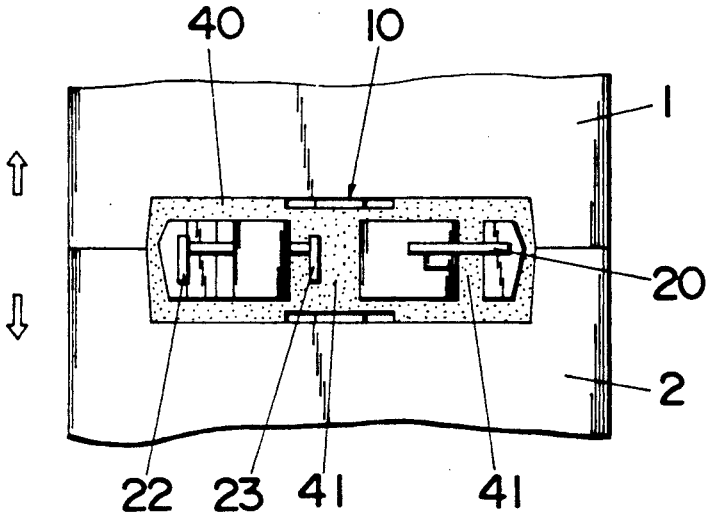
FIG. 11 is a schematic view illustrating the switch housing held between molding dies for injection-molding an annular seal member on the periphery of the housing.

An annular seal member 40 is injection-molded on the top peripheral mating surface of the switch housing 10 by an elastic material such as polyethylene elastomer so as to be integrally adhered thereto for effecting continuous circumference sealing with the lower end of the cover 50. As shown in FIG. 11, separable molding dies 1 and 2 are utilized to hold therebetween the molded switch housing 10, at which condition, an elastic material is injected around the top surface of the housing 10 to form thereat the integrally adhered annular seal member 40. The spring 30 is mounted to the carriers 22 and 23 after the molding of the seal member 40. Throughholes 16 formed in the housing 10 may be adapted to receive corresponding pins (not shown) of the molding dies 1 and 2 for exact positioning of the housing 10 between the dies 1 and 2. As shown in FIGS. 1, 3, and 11, the annular seal member 40 includes bridge segments 41 which bridge the opposed ends of the annular seal member 40 in a separating direction (indicated by arrows in FIG. 11) of the molding dies 1 and 2 in order that the annular seal member 40 exhibits enough resistance to the separating force applied at the time of the separating the dies 1 and 2 to be thereby kept firmly adhered on the peripheral surface of the switch housing 10. Thus, the annular seal member 40 can be prevented from being pulled apart from the switch housing 10 at the time of taking the housing 10 out of the molding dies 1 and 2, and is therefore kept adhered in place on the periphery of the housing 10 to assure an effective continuous seal against the cover 50 over an extended period of use. Although two bridge segments 41 are formed in this embodiment, a single bridge segment may be enough to reinforce the annular seal member.

Figure 4:
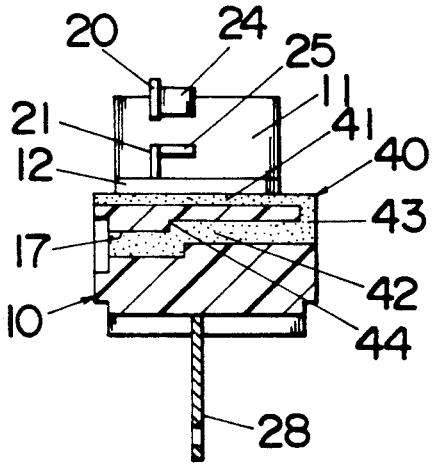
FIG. 4 is a cross section taken along line X—X of FIG. 3.

In this embodiment, a further reinforcement of the annular seal member 40 is effected by means of an additional anchor segment 42 extending into a bore 17 formed in the housing 10 in the separating direction of the molding dies 1 and 2, as shown in FIG. 4. The bore 17 is filled with the elastic material at the time of injection-molding to form therein the anchor segment 42 which is embedded in the housing 10 and integrally connected at its end to the annular seal member 40 at 43 to thereby retain the annular seal member 40 in place against the separating force. The bore 17 has a bend intermediate its ends to leave on the resulting anchor segment 42 a correspondingly bent shoulder 44 which is in engagement with the bend to firmly holding the anchor segment 42, further increasing the resistance of the annular seal member 40 against the separating force.

Figure 12A:
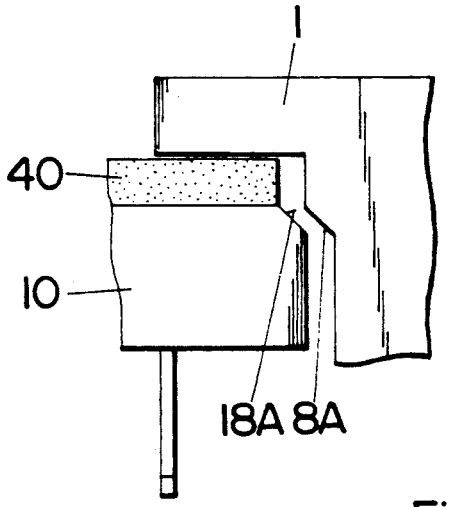
FIGS. 12A to 12C are respectively partial views illustrating various drafts formed on the contacting surfaces of the switch housing with the molding dies.
Figure 12B:
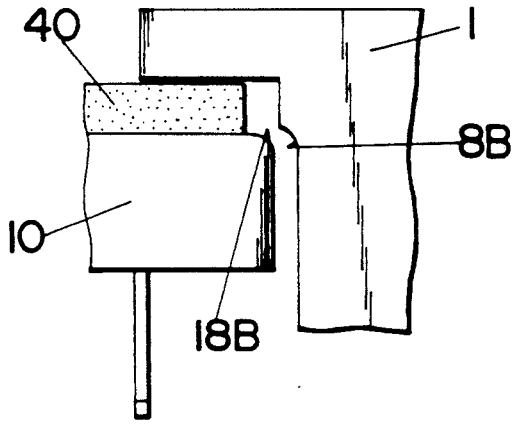
Figure 12C:
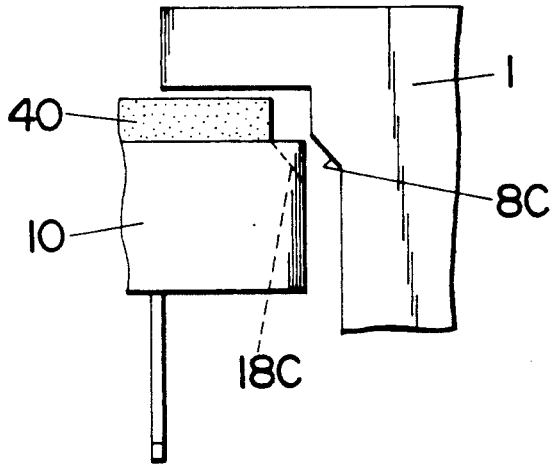
Figure 13:
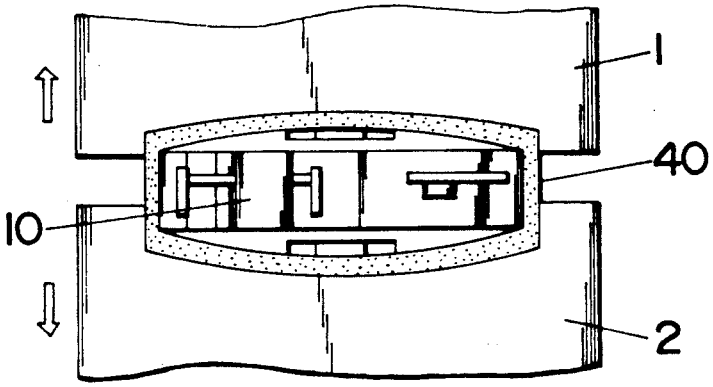
Fig.13 PRIOR ART
FIG. 13 is a schematic view which is similar to FIG. 11, but is presented for the purpose of illustrating a problem to be solved by the present invention.

In order to facilitate the injection molding, the switch housing 10 and the molding dies 1 and 2 are both designed, as shown in FIGS. 12A to 12C, to have drafts 18A, 18B, 8A, 8B, and 8C on the abutting surfaces which are suitable tapered in relation to the separating directions of the dies 1 and 2 such that the housing 10 can be easily removed from the dies 1 and 2 without a possibility of being scraped by the edge of the dies 1 and 3. This is particularly advantageous in that, if scratching arises the scraped particles or powders would remain around the peripheral surface of the switch housing 10 to impair the sealing member being molded thereon and eventually lower the sealing effect, in addition to that there might arise undesired burrs on the molded seal member without the drafts. The drafts may be generally straight as shown at 18A and 8A in FIG. 12A, or rounded as shown at 18B and 8B in FIG. 12B. Alternately, an upper end corner of the housing 10 may be flattened into a tapered edge 18C by a draft 8C on the die 1 at the time of closing the dies on the housing.

Figure 5:
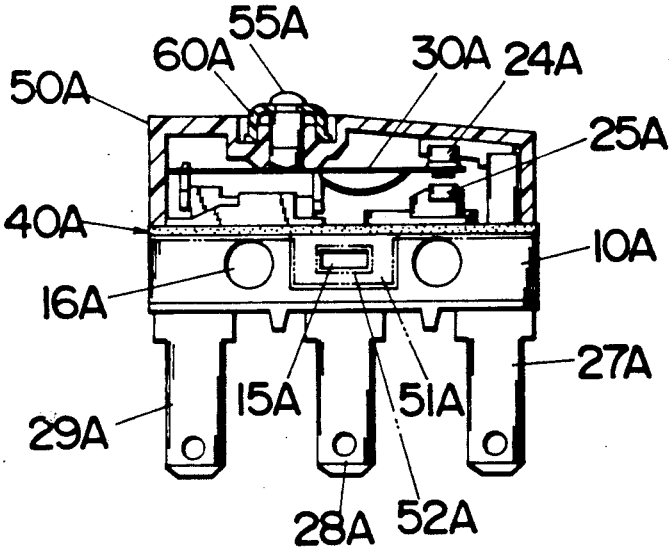
FIG. 5 is an elevation of a sealed electric switch in accordance with a modification of the above embodiment.
Figure 6:
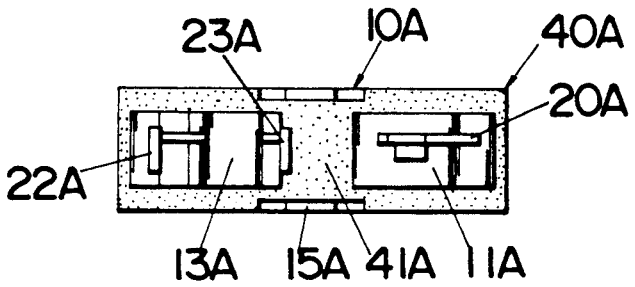
FIG. 6 is a top view of a switch housing of FIG. 5.
Figure 7:
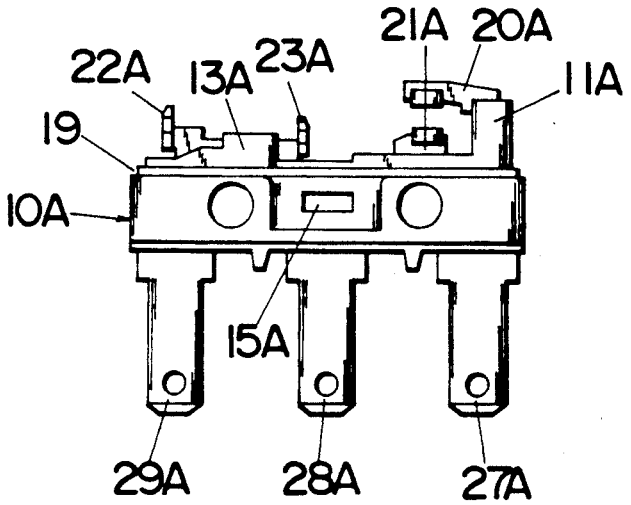
FIG. 7 is an elevation of a modification of FIG. 5.

Although the above bridge segment 41 and the anchor segment 42 are utilized in combination to reinforce the annular seal member 40 in this embodiment, one of these segments may be alone sufficient for the reinforcement purpose. FIGS. 5 and 6 show a modification of the above embodiment in which a single bridge segment 41A is formed to bridge the opposed ends of an annular seal member 40A in the separating direction of the dies. In this modification, a cover 50A is formed to have a pair of center flaps 51A with like catch holes 52A for snap engagement with corresponding pegs 15A on the side center of the housing 1OA. Other structures are identical to the above embodiment and therefore like parts are designated by like numerals with a suffix letter "A". To achieve further secure adherence of the seal member, a switch housing 10A may be formed to have a stepped peripheral surface 19 on which an annular seal member is injection-molded.

Figure 8:
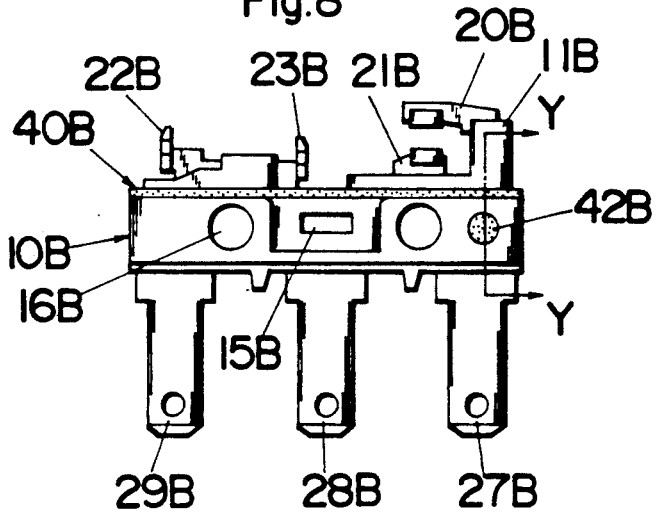
FIG. 8 is an elevation of a switch housing in accordance with a further modification of the above embodiment.
Figure 9:
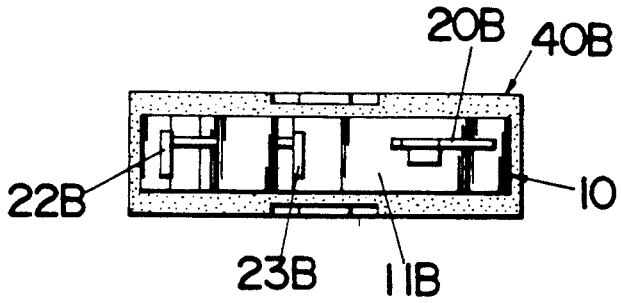
FIG. 9 is a top view of the switch housing of FIG. 8.
Figure 10:
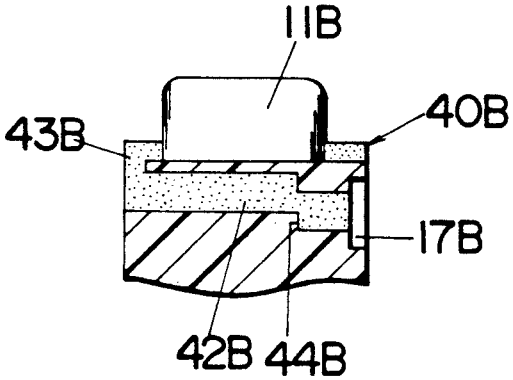
FIG. 10 is a cross section taken along line Y—Y of FIG. 8.

FIGS. 8 to 10 illustrate another modification in which an annular seal member 40B is reinforced singly by a like anchor segment 42B with like shoulder 44B. The anchor segment 42B is embedded in a switch housing 10B and is integrally connected to an annular seal member 10B through a member 43 in the like manner as in the above embodiment. As described above, the anchor segment 43 can give enough resistance to the separating force applied to the seal member 40B at the time of separating the molding dies and therefore can be alone sufficient to keep the annular seal member 40B in place for effective seal against the lower end of the cover.

What is claimed is:

1. A sealed electric switch comprising:

a molded switch housing with contacts and terminals;

a separately formed cover which is fitted on said molded switch housing in mating contact between peripheries of said switch housing and said cover;

an annular seal member disposed on a peripheral mating surface of said switch housing so as to effect a sealing between said switch housing and said cover, said annular seal member being injection-molded from an elastic material on said peripheral mating surface of said molded switch housing between separable molding dies with said switch housing held therebetween; and said annular seal member integrally formed with at least one bridge segment which bridges opposed ends of said annular seal member in a separating direction of said molding dies.

2. A sealed electric switch as set forth in claim 1, wherein said switch housing is formed with drafts at contacting surfaces with corresponding surfaces of said molding dies to facilitate removal of said switch housing from said molding dies.

3. A sealed electric switch comprising:

a molded switch housing with contacts and terminals;

a separately formed cover which is fitted on said molded switch housing in mating contact between peripheries of said switch housing and said cover;

a generally planar annular seal member disposed on a peripheral mating surface of said switch housing so as to effect a sealing between said switch housing and said cover, said annular seal member being injection-molded from an elastic material on said peripheral mating surface of said switch housing between separable molding dies with said switch housing held therebetween; and said switch housing being formed with a bore extending therethrough in a separating direction of said molding dies, said bore having two ends, said bore being filled with said elastic material during said injection-molding to form therein an embedded anchor segment which extends within the switch housing and parallel to the plane of said annular seal and in said separating direction and has at least one of its ends integrally joined to said annular seal member.

4. A sealed electric switch as set forth in claim 3, wherein said bore is formed to have a bend intermediate its ends to form a corresponding bent portion within the length of the resulting segment such that said bend and bent portion are engaged with each other in the separating direction of said molding dies.

5. A sealed electric switch as set forth in claim 3, wherein said switch housing is formed with drafts at contacting surfaces with corresponding surfaces of said molding dies to facilitate removal of said switch housing from said molding dies.

* * * * *